United States Patent [19]

Nederlof

[11] 4,055,953

[45] Nov. 1, 1977

[54] HOT-GAS RECIPROCATING ENGINE

[75] Inventor: Anton Marie Nederlof, Eindhoven, Netherlands

[73] Assignee: U.S. Philips Corporation, New York, N.Y.

[21] Appl. No.: 700,750

[22] Filed: June 29, 1976

Related U.S. Application Data

[63] Continuation of Ser. No. 596,186, July 15, 1975, abandoned, which is a continuation of Ser. No. 513,241, Oct. 9, 1974, abandoned.

[30] Foreign Application Priority Data

Oct. 31, 1973 Netherlands ..... 7314928

[51] Int. Cl.[2] ..... F02G 1/04

[52] U.S. Cl. ..... 60/526; 60/517

[58] Field of Search ..... 60/517–526

[56] References Cited

U.S. PATENT DOCUMENTS

| | | | |
|---|---|---|---|
| 3,702,533 | 11/1972 | Dirne et al. | 60/524 |
| 3,817,322 | 6/1974 | Asselman et al. | 60/517 |
| 3,861,146 | 1/1975 | Lynch | 60/524 |

*Primary Examiner*—Allen M. Ostrager
*Attorney, Agent, or Firm*—Frank R. Trifari; David R. Treacy

[57] ABSTRACT

A hot-gas reciprocating engine in which the tubular connection members interconnect a heater duct inside the heat pipe with the engine's expansion space and regenerator, each connection member extends transverse of the center line of the relevant unit, and is connected to the heat pipe wall with a flexible sealing member.

10 Claims, 7 Drawing Figures

HOT-GAS RECIPROCATING ENGINE

This is a continuation of the application having Ser. No. 596,186 filed July 15, 1975, abandoned; which was a continuation of the application having Ser. No. 513,241 filed Oct. 9, 1974 abandoned.

BACKGROUND OF THE INVENTION

The invention relates to a hot-gas reciprocating engine comprising a heater serving as a heat exchanger which is situated inside a heat pipe and includes a bundle of heater pipes which communicate on the one side with a working space of variable volume and higher temperature during operation inside a cylinder unit, and communicate communicating on the other side with a regenerator unit. The heater pipes on at least one side of the bundle of pipes are connected to the relevant unit by way of one or more tubular connection members which are passed through a wall of the heat pipe.

Hot-gas reciprocating engines of the kind set forth are known as appears from the FIGS. 13 and 16 of the article "Prospects of the Stirling engine for vehicular propulsion" (Philips Technical Review, Vol. 31, 1970, No. 5/6

Eaxmples of heaters of hot-gas reciprocating engines which are composed of bundles of pipes are described in British Patent Nos. 708,199 and 898,270, while for the properties of heat pipes reference is made to, U.S. Pat. Nos. 3,229,759 and 3,402,767.

The tubular connection members which connect the heater pipes to the cylinder unit and the regenerator unit, respectively, in the known hot-gas reciprocating engines are passed through the rigid bottom plate of the heat pipe and extend parallel to the center line of the relevant unit.

A problem of this construction are the large material stresses occurring in the bottom plate and the connection members during operation of the engine, thus causing leakage of the heat pipe and of the heater pipes through which the working medium of the engine (for example, helium or hydrogen) flows. Because of the thermal expansion occurring at the relevant operating temperatures of approximately 800° C, the diameter of the bottom plate is substantially increased. In addition, the parts of the cylinder and the regenerator which are at a high temperature also expand, while the parts of the cylinder and the regenerator which are at a low temperature are rigidly connected to each other, thus causing relative displacement and rotation of the parts of higher temperature. The said material stresses thus appear.

It could be contemplated to make the construction of the bottom plate of the heat pipe flexible. However, on the one hand it is very difficult and expensive to manufacture such flexible plates, and on the other hand this would necessitate the use of thin plates. The latter is not acceptable because, depending on the operating temperature, the pressure of the heat transport medium in the heat pipe (for example, sodium or lithium) is usually lower or higher than the ambient atmospheric pressure. The pressure difference on both sides of the plate then causes pressure forces or tensile forces to be exerted on this plate. The thin plate at a high temperature has insufficient mechanical strength to withstand these forces in the course of time.

The invention has for its object to provide a hot-gas reciprocating engine of the kind set forth in which the said problems are eliminated.

SUMMARY OF THE INVENTION

The hot-gas reciprocating engine according to the invention is characterized in that the connection members extend in directions transverse to the center line of the unit where they are connected, these members being sealed with respect to the heat pipe wall by way of flexible sealing members. By this construction it is achieved in a structurally simple manner, that the boot pipe wall (bottom plate) through which the connection members are passed can freely expand, and that no material stresses are developed in the connection members.

The invention will be described in detail hereinafter with reference to the drawing.

DETAILED DESCRIPTION OF THE PREFERRED EMBODIMENTS

Figure 1:
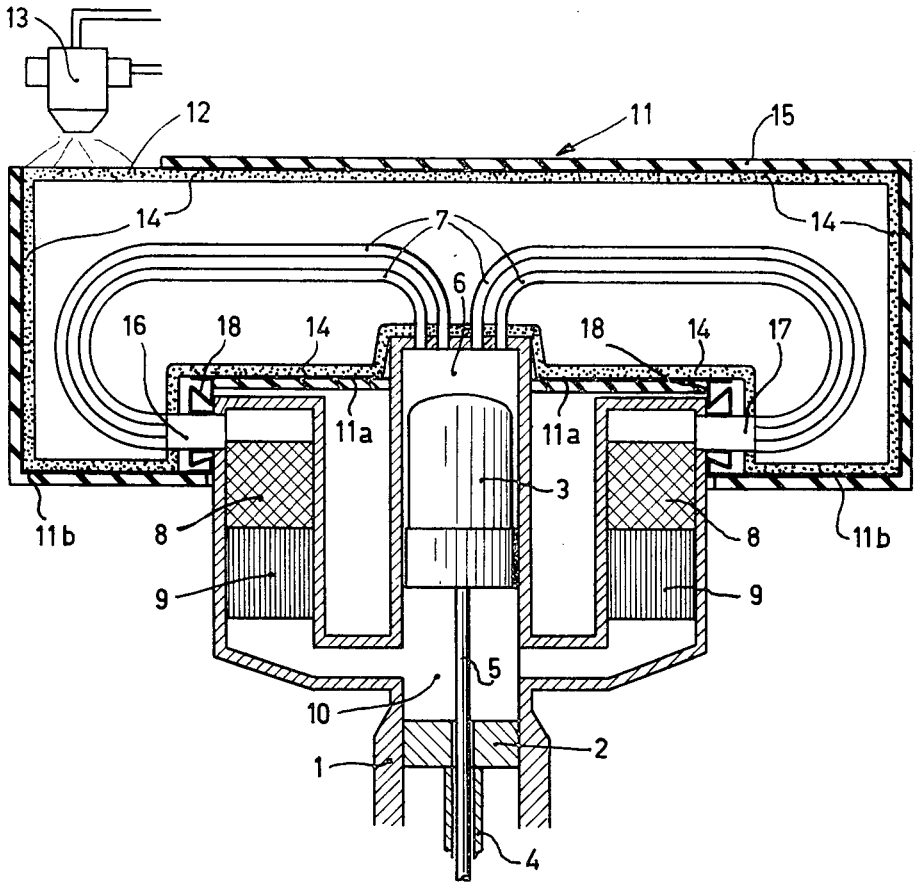
FIGS. 1 to 7 are partial elevation views in section of different embodiments of the hot-gas reciprocating engine according to the invention (not to scale).

The reference numeral 1 in FIG. 1 denotes a cylinder in which a piston 2 and a displacer 3 are reciprocable at a phase difference with respect to each other. Piston 2 is connected to a drive not shown by way of a piston rod 4, while displacer 3 is connected thereto by way of a displacer rod 5 which is passed through the piston rod 4.

Present above displacer 3 is an expansion space 6 of higher mean temperature during operation which communicates, via a heater composed of the pipes 7, a regenerator 8 and a cooler 9, with a compression space 10 of lower mean temperature during operation.

A working medium such as hydrogen can flow to and fro between these spaces via this connection. In this case the regenerator 8 has an annular construction and is coaxially arranged about the cylinder 1. However, the regenerator 8 (like the cooler 9) can alternatively be subdivided into a number of separate units which are arranged in a ring about the cylinder.

The heater pipes are arranged inside a heat pipe 11 which is a closed reservoir containing a quantity of heat transport medium such as sodium. Heat pipe 11 comprises an evaporation wall 12 whereto heat originating from a burner unit 13 can be applied. During operation sodium evaporates from the evaporation wall 12 and condenses on the heater pipes 7 while giving off to the working medium of the engine flowing through these pipes. The condensate is returned to the evaporation wall 12 by a capillary structure 14 which is composed, for example, of layers of gauze. With the exception of the area of the evaporation wall 12, the heat pipe 11 is thermally insulated from the surroundings by a heat insulating layer 15.

The heater pipes 7 are connected to the regenerator 8 by way of tubular connection members 16 and 17. In the embodiment shown two heater pipes open into one connection member. The connection members 16 and 17 extend transverse to the center line or central axis of the regenerator/cooler unit. Provided between the connection members 16 and 17 and the heat pipe walls are flexible sealing members 18, for example, in the form of bellows or diaphragms.

The bottom wall portions 11a and 11b of heat pipe 11 can freely expand when the engine is brought to the high operating temperature. The forces exerted thereby on the sealing members 18 cause these members to yield, while the connection members 16 and 17 which pass through the heat pipe walls remain free from mechanical stresses caused by expansion of the bottom wall of the heat pipe, and stresses caused indirectly by relative displacement and rotation of cylinder 1 and regenerator 8, respectively.

FIGS. 2 to 7 are longitudinal sectional views of multi-cylinder double-acting hot-gas engines. In comparison with FIG. 1, parts which are irrelevant to the present invention have been omitted.

Figure 2:
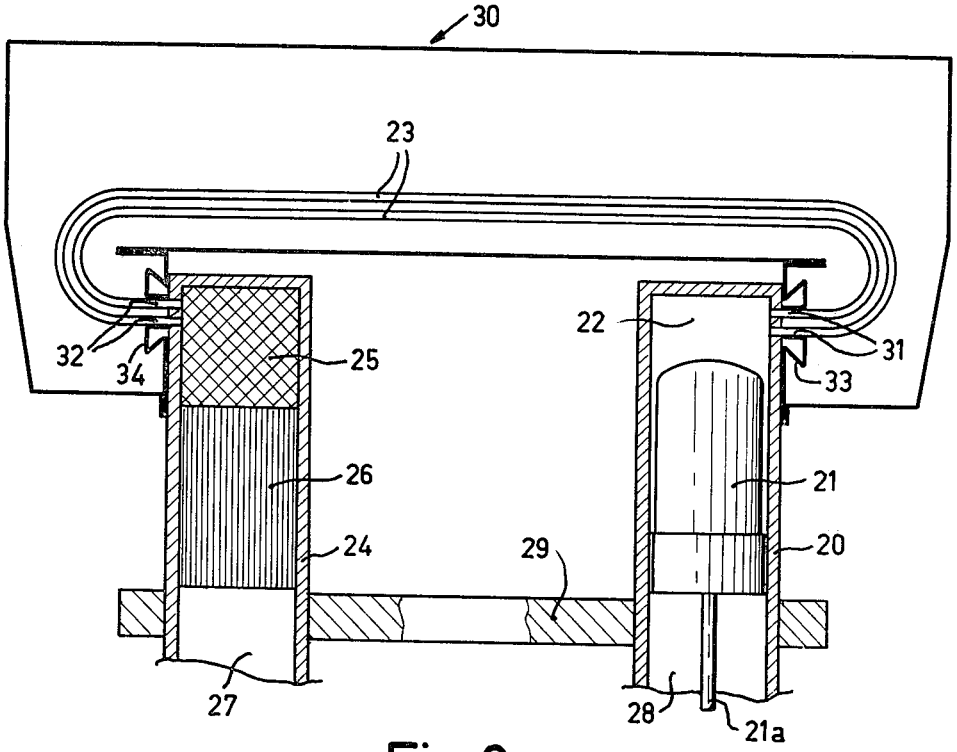

FIG. 2 shows a cylinder 20 in which a piston 21 is reciprocated, the piston connected via piston rod 21a, to a drive not shown. Above the piston 21 is an expansion space 22 which communicates, via heater pipes 23, with a housing 24 accommodating a regenerator 25 and a cooler 26. Space 27 below cooler 26 communicates with a compression space in a cylinder not shown. Space 28 in cylinder 20 below piston 21 constitutes a compression space which communicates with a cooler/regenerator unit not shown. For double-acting hot-gas engines, further reference is made to the article mentioned in the preamble and said British Pat. No. 708,199. The cylinders and regenerator/cooling units are rigidly interconnected on the side of lower temperature during operation by a bottom plate 29.

Within the heat pipe 30 are heater pipes 23 connected on the one side, by way of connection members 31 which are passed through a wall of the heat pipe 30, to the cylinder 20, and on the other side, by way of the connection members 32 passed through a wall of the heat pipe, to housing 24. The connection members 31 extend transverse to the center line or central axis of cylinder 20, and the connection members 32 extend transverse to the center line of the housing 24. Present between the connection members 31 and the enveloping heat pipe is a flexible sealing member 33, while a flexible sealing member 34 is provided between the connection members 32 and the enveloping heat pipe wall.

It is thus again achieved that the bottom walls of heat pipe 30 can freely expand during operation of the engine and do not cause mechanical loading of the connection members due to the yielding of the flexible sealing members.

Parts shown in the FIGS. 3 to 7 which correspond to parts shown in FIG. 2 are denoted by the same reference numerals.

Figure 3:
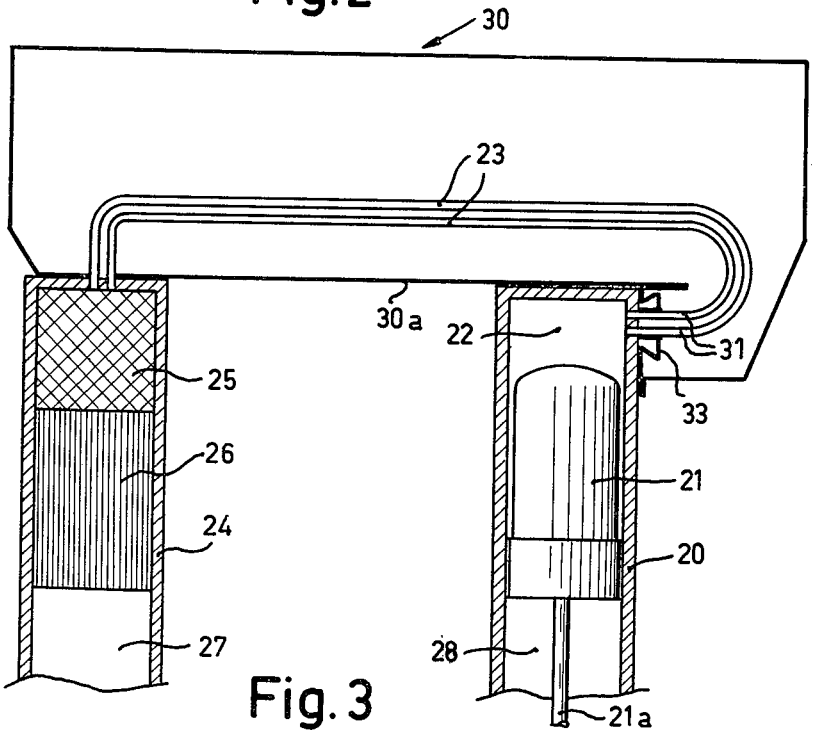

In the engine shown in FIG. 3, only the connection members on the side of the cylinder extend transverse to the centre line of the cylinder and are connected to the heat pipe by way of a flexible sealing member. This is sufficient to ensure free expansion of the heat pipe bottom without mechanical loading of the connection members on both sides of the heater pipes. Bottom wall **30*a* then exerts a tensile force on the sealing member 33**.

Figure 4:
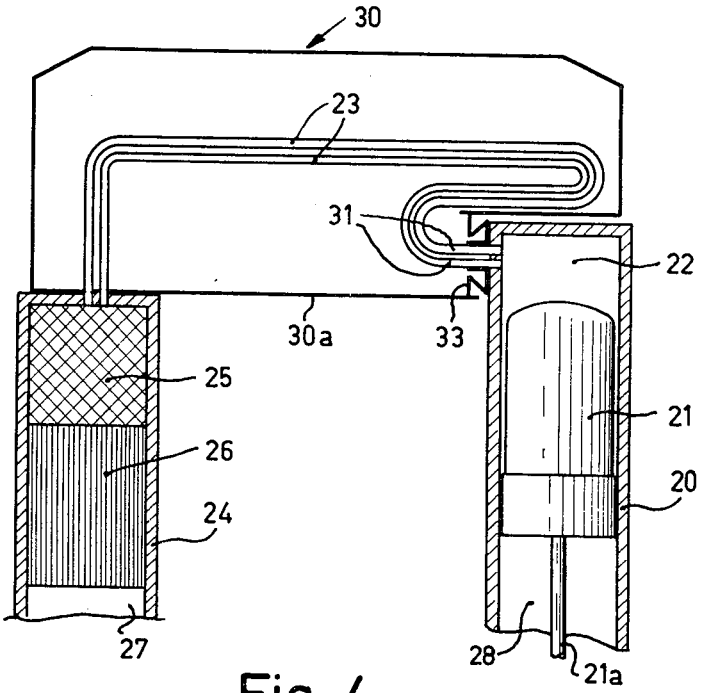

FIG. 4 is a variant of FIG. 3, wherein bottom wall **30*a* of heat pipe 30 exerts a pressure force instead of a tensile force on sealing member 33** in the case of expansion.

Figure 5:
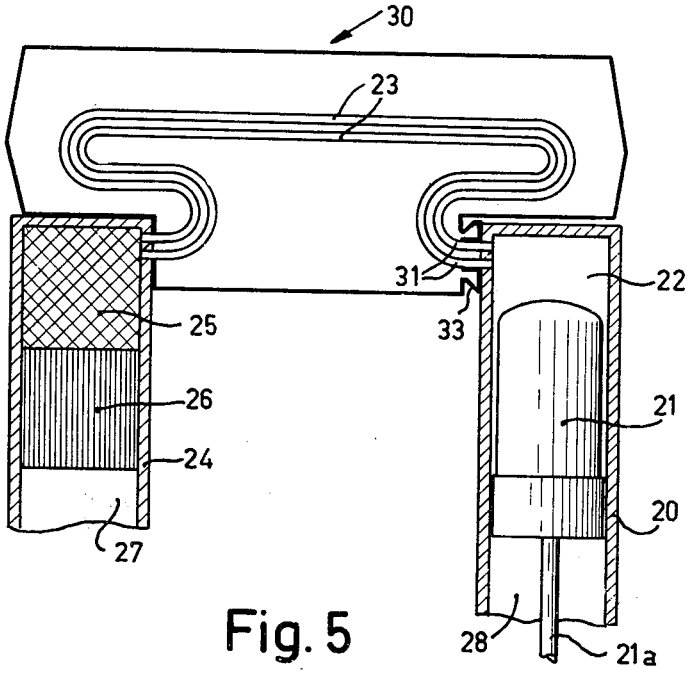

FIG. 5 shows an embodiment in which the connection members on both sides of the heater pipes extend transverse to the center line of the associated regenerator unit and cylinder, respectively. However, a flexible sealing member 33 is provided only for the connection members 31 at cylinder 20.

Figure 6:
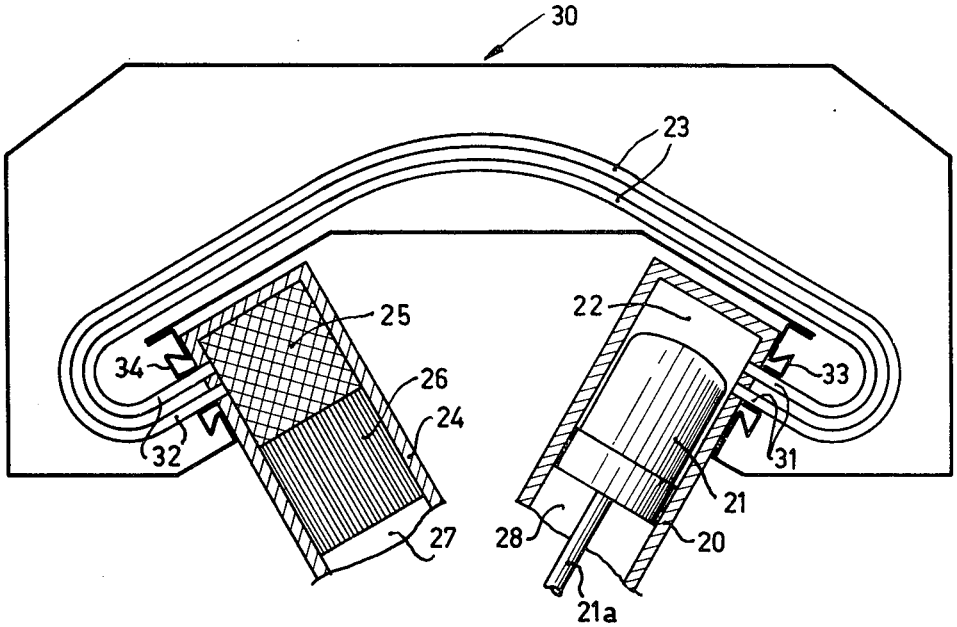

The hot-gas engine shown in FIG. 6 is of the V-type in which the cylinders and the regenerator units connected thereto enclose an angle relative to each other. The construction, however, corresponds further to that of FIG. 2.

Figure 7:
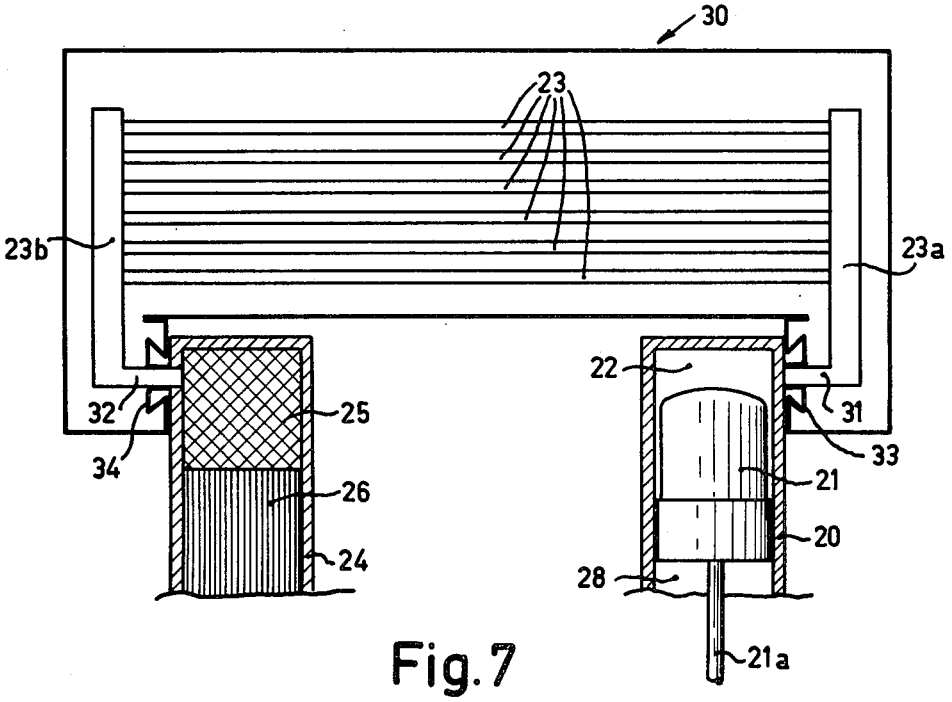

The construction of the hot-gas engine shown in FIG. 7 is basically the same as that of FIG. 2, except that the heater pipes 23 on both sides open into a collection duct **23*a* and 23*b*, respectively, each collection duct communicating with the cylinder 20 and the regenerator 25, respectively, by way of only one connection member 31 and 32**, respectively.

I claim:

1. A hot-gas reciprocating engine comprising a cylinder unit having a working space of variable volume and higher temperature during operation; a regenerator unit; a heat pipe; a heater serving as a heat exchanger arranged inside the heat pipe and comprising at least a bundle of heater pipes; and one or more tubular members which pass through a wall of the heat pipe, said heater pipes communicating on one side with the working space, and on an other side with the regenerator unit, at least one of said units having a center line and being connected to the heater pipes by at least one of said members, wherein said members extend transversely to the center line of the unit to which they are connected, and the engine further comprises flexible sealing members for sealing said connection members to the heat pipe wall.

2. In a hot gas engine including a housing, a regenerator, a cylinder and displacer defining together a variable-volume expansion space, a heater comprising a heater duct having first and second ends communicating with said expansion space and said regenerator respectively, and a heat pipe generally surrounding said heater duct for supplying thermal energy thereto, the improvement in combination therewith, wherein said cylinder and displacer component has a central axis along which the displacer is reciprocated, and said regenerator component has a central axis corresponding to the flow direction of fluid therethrough, and said improvement comprises a tubular connection member oriented transverse of the central axis of at least one of said components and engaging and interconnecting said component and one of said heater duct ends, said member traversing said heat pipe wall with a clearance space defined therebetween, said improvement further comprising flexible seal means sealing said clearance space, whereby, a continuous fluid path is provided between said expansion space and said regenerator through said heater duct and connection member.

3. Apparatus according to claim 2 comprising two of said connection members, the first connection member interconnecting said first end of the heater duct and said expansion space, and the second connection member interconnecting said second end of the heater duct and said regenerator.

4. Apparatus according to claim 2 wherein said connection member interconnects said first end of the heater duct and said expansion space.

5. Apparatus according to claim 2 wherein said connection member interconnects said second end of the heater duct and said regenerator.

6. Apparatus according to claim 3 wherein said central axis of said cylinder and displacer and said regenerator are generally parallel.

7. Apparatus according to claim 3 wherein said central axis of said cylinder and displacer and said regenerator intersect, defining a V.

8. Apparatus according to claim 2 wherein said seal means comprises a bellows.

9. Apparatus according to claim 2 wherein said heat pipe wall, in operation, expands, and applies a tensile force on the seal means to which it is engaged.

10. Apparatus according to claim 2 wherein said heat pipe wall, in operation, expands, and applies compression force on the seal means to which it is engaged.

* * * * *